US005501296A

United States Patent [19]

Fletcher

[11] Patent Number: 5,501,296

[45] Date of Patent: Mar. 26, 1996

[54] DUAL POST SINGLE SCREW AUTOMOTIVE SCREW LIFT SYSTEM

[75] Inventor: Robert H. Fletcher, San Diego, Calif.

[73] Assignee: Advantage Lift Systems, Inc., San Diego, Calif.

[21] Appl. No.: 357,853

[22] Filed: Dec. 16, 1994

Related U.S. Application Data

[63] Continuation-in-part of Ser. No. 194,058, Feb. 9, 1994, Pat. No. 5,404,968.

[51] Int. Cl.[6] ..... B66F 7/10

[52] U.S. Cl. ..... 187/210; 187/267

[58] Field of Search ..... 187/205, 210, 187/218, 221, 214, 267; 254/92, 98

[56] References Cited

U.S. PATENT DOCUMENTS

| | | | |
|---|---|---|---|
| 3,757,898 | 9/1973 | Mitchell et al. | 187/205 |
| 4,022,428 | 5/1977 | Mantha | 187/210 |

FOREIGN PATENT DOCUMENTS

| | | | |
|---|---|---|---|
| 240662 | 6/1946 | Denmark | 187/210 |

*Primary Examiner*—Kenneth Noland

*Attorney, Agent, or Firm*—M. K. Silverman

[57] ABSTRACT

An automotive lift system includes an environment-defining enclosure having an upwardly directed mouth positioned substantially at work level of the system, the enclosure defining both a longitudinal and a transverse axis. The lift system also includes an in-ground anchoring of the enclosure relative to reactive forces generated by vehicles during lifting by the system, the anchoring disposed substantially at the work level and about the mouth of the enclosure. A rigid support frame is secured upon inner annular surfaces of the anchoring, defining a rigid horizontal plane at the mouth of the enclosure and co-parallel with it. Vertically-oriented cylindrical collars are secured to opposite longitudinal ends of the support frame. Further, a vertically oriented elongated screw drive having an upper end and a lower end, the upper end including an annular thrust bearing, is positioned at about the level of the support frame. The system further includes a motor for imparting selectable rotation to the screw drive, an output of the motor in mechanical linkage to the thrust bearing of the screw drive. A load nut is screw-threadably and non-rotationally mounted about the screw drive. Further provided is a horizontal cross-beam, which is rigidly mounted upon the load nut, co-parallel with the longitudinal axis of the enclosure. A load nut mounting tube is positioned radially outwardly of the screw drive, the tube having a lower end rigidly mounted upon the load nut.

20 Claims, 11 Drawing Sheets

DUAL POST SINGLE SCREW AUTOMOTIVE SCREW LIFT SYSTEM

REFERENCE TO RELATED APPLICATION

This case is a continuation-in-part of application Ser. No. 08/194,058, filed Feb. 9, 1994 now U.S. Pat. No. 5,404,968, entitled Automotive Screw Lift System with Interchangeable Components.

BACKGROUND OF THE INVENTION

The present invention relates to the art of automotive lift systems and, more particularly, to lifts of the type used in automobile service stations.

The invention more particularly relates to the area of in-ground non-hydraulic automotive lift systems.

At about the time of the advent of in-ground hydraulic automotive lift systems, which occurred in the year 1921, certain limited efforts were made to create a non-hydraulic automotive lift employing a thrust screw in combination with a load nut mounted thereon. Examples known to the inventor of these efforts are reflected in U.S. Pat. Nos. 1,585,596 (1926) to Menges and 1,650,438 (1927) to Gass. Notwithstanding such early experimentation at about the time of the initial development of the in-ground hydraulic lift, most later efforts in connection with automotive screw lifts related to above ground systems of the type reflected in U.S. Pat. No. 3,602,338 (1971) to Sherry. However, For the most part, the use of screw lift systems in the automotive area have been limited to jack-type devices for use above ground and with relatively light vehicles, as is reflected in U.S. Pat. No. 3,532,322 (1970) to Webster. Therefore most in-ground lifts during the period 1921 to 1970 were hydraulic, not screw lifts.

It is noted that, in non-automotive areas, such as the elevator lift art, various screw drive mechanisms have been proposed, as, for example, is shown in U.S. Pat. No. 3,468,401 (1969) to Letz.

By about 1970, government and the public became aware that in-ground hydraulic lifts, utilizing as they do hundreds of gallons of hydraulic fluid per year, give rise to an environmental hazard of proportions which are only now becoming fully apparent. More particularly, hydraulic fluid, while for the most part comprising an oil-based hydrocarbon, includes certain caustic and heavy metal additives including iron, lead, copper, tin, aluminum, nickel, phosphorus, molybdenum and cadmium. These additives, if permitted to penetrate the water table, can give rise to contamination of the water supply at concentrations of only a few parts per billion. There is, thereby, a burgeoning awareness on the part of environmental officials and others that the hydraulic lift, which has been a standard in service stations throughout the world since 1920, presents an actual and/or potential health hazard of still unmeasured magnitude, whether the lift is positioned in-ground or above ground, as has been common since 1970.

The above problem, as may be appreciated, is more acute in areas where the water table is very high, such as in coastal areas of Florida and Louisiana where the water table can be as high as two feet below the surface. Thereby, the typical prior art in-ground hydraulic lift, which is installed to a depth of about nine feet in the ground, presents a particularly serious hazard in such areas. Further, the state-of-the-art of monitoring (typically means such as microwave and electronic systems) of the extent, location and form of ground pollution has made it feasible to conduct environmental surveys of virtually any business or industrial site for purposes of location of pollution, whether occurring as a result of system leakage or otherwise. It is anticipated that government will soon begin to use this capability.

In response to the above factors, so-called above-ground lifts were developed. However, a difficulty with such above-ground lifts is that they are not space efficient, that is, four in-ground lifts can fit into the space of three above-ground lifts. Accordingly, above-ground hydraulic lifts have several major problems, that is, they are not space-efficient and create floor space clutter. The best solution therefore would be that of an in-ground, non-hydraulic system that could compete with above-ground hydraulic systems. Such a solution is offered by the present invention.

The instant invention may, thereby, be viewed as a response to the recognition of the environmental hazards associated with all hydraulic lift technology.

SUMMARY OF THE INVENTION

The inventive automotive lift system includes an environment-defining enclosure having an upwardly directed mouth thereof, said mouth positioned substantially at a work level of the system, said enclosure defining both a longitudinal and a transverse axis. The instant lift system also includes means for in-ground anchoring of said enclosure relative to reactive forces generated by vehicles during lifting thereof by the system, said anchoring means disposed substantially at said work level and about said mouth of said enclosure. A rigid support frame is secured upon inner annular surfaces of said anchoring means, thereby defining a rigid horizontal plane at said mouth of said enclosure and co-parallel therewith. Vertically-oriented cylindrical collars are secured to opposite longitudinal ends of said support frame. Further, a vertically oriented elongated screw drive having an upper end and a lower end, said upper end including an annular thrust bearing, is positioned at about the level of said support frame. The system yet further includes power means for imparting selectable rotation to said screw drive, an output of said means in mechanical linkage to said thrust bearing of said screw drive. A load nut is screw-threadably and non-rotationally mounted about said screw drive. Further provided is a horizontal cross-beam, which is rigidly mounted upon said load nut, co-parallel with said longitudinal axis of said enclosure. A load nut mounting tube is positioned radially outwardly of said screw drive, said tube having a lower end thereof rigidly mounted upon said load nut. There is yet further provided a plurality of vertically-disposed cylindrical plungers each having exterior diameters proportioned for slidable insertion through interior diameters of said cylindrical collars, each plunger having an upper end and a lower end, each lower end thereof secured upon said vertical cross-beam, each cylindrical plunger passing vertically upwardly through a respective one of said collars. The inventive system yet further includes automotive superstructure support means secured at each of said upper ends of said cylindrical plungers, It is an object of the invention to provide an in-ground, non-hydraulic automobile lift system.

It is another object to a floor space efficient system.

It is a further object of the invention to provide an automotive lift system not having any environment-related risk.

It is a yet further object to provide a system having the above advantages and which is cost-effective with prior art hydraulic lifts.

It is a still further object to provide a system in which the motor and other elements may be conveniently serviced and if needed, relocated.

The above and yet other objects and advantages of the present invention will become apparent from the hereinafter set forth Brief Description of the Drawings, Detailed Description of the Invention and claims appended herewith.

DETAILED DESCRIPTION OF THE INVENTION

Figure 1:
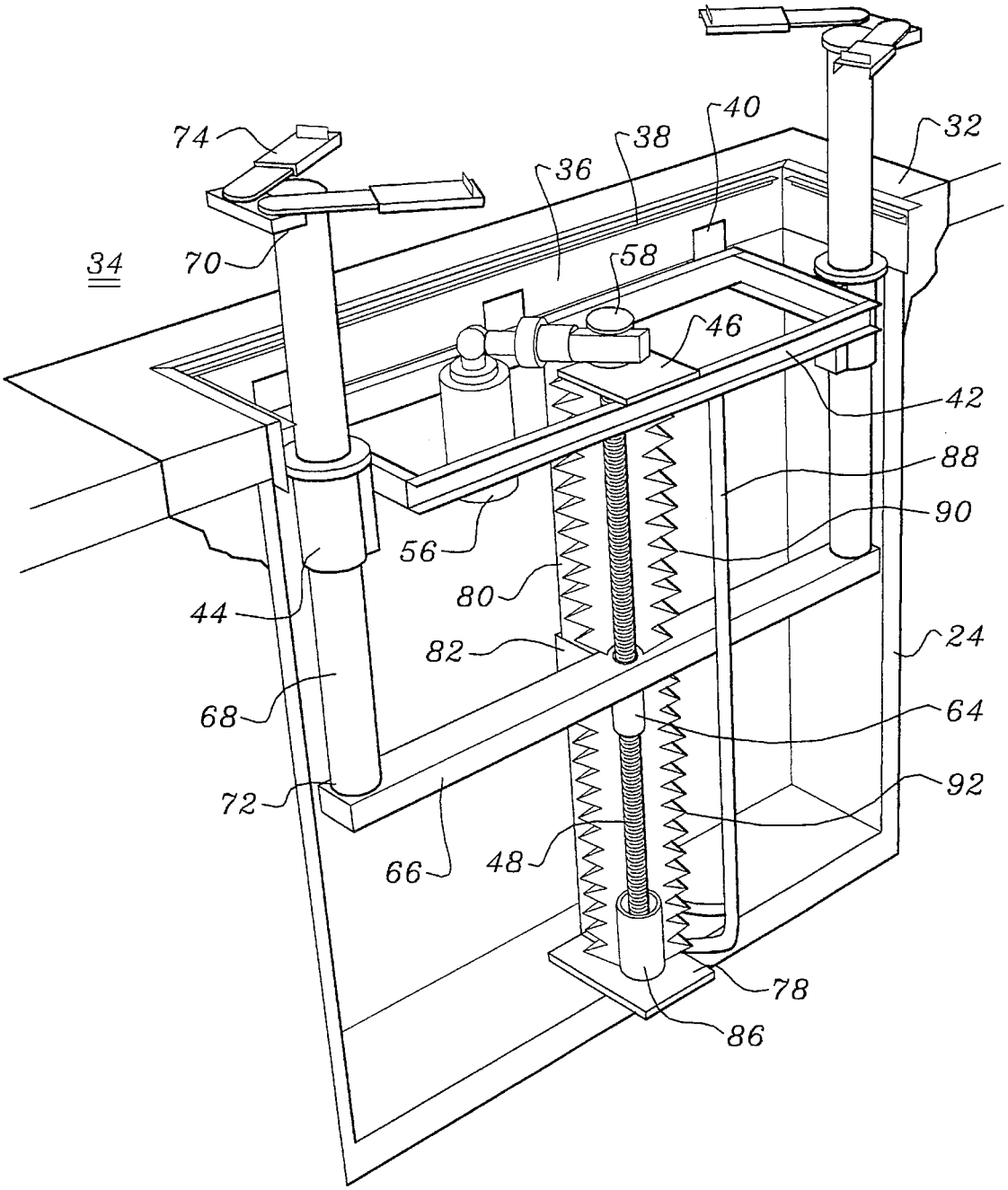
FIG. 1 is a schematic, partial break-away view of the inventive dual post automotive screw lift system.
Figure 10:
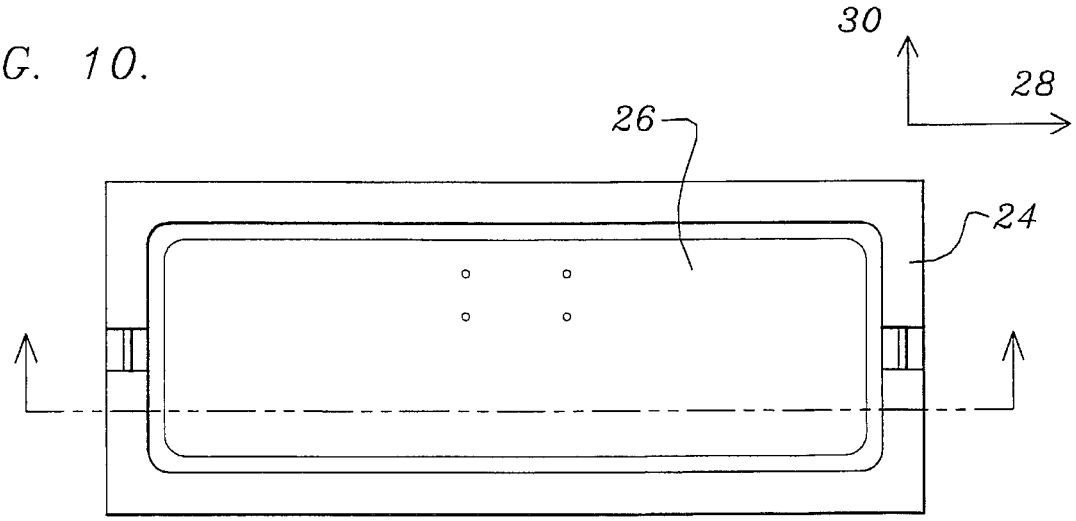
FIG. 10 is a top plan view of the environment-defining enclosure.
Figure 9:
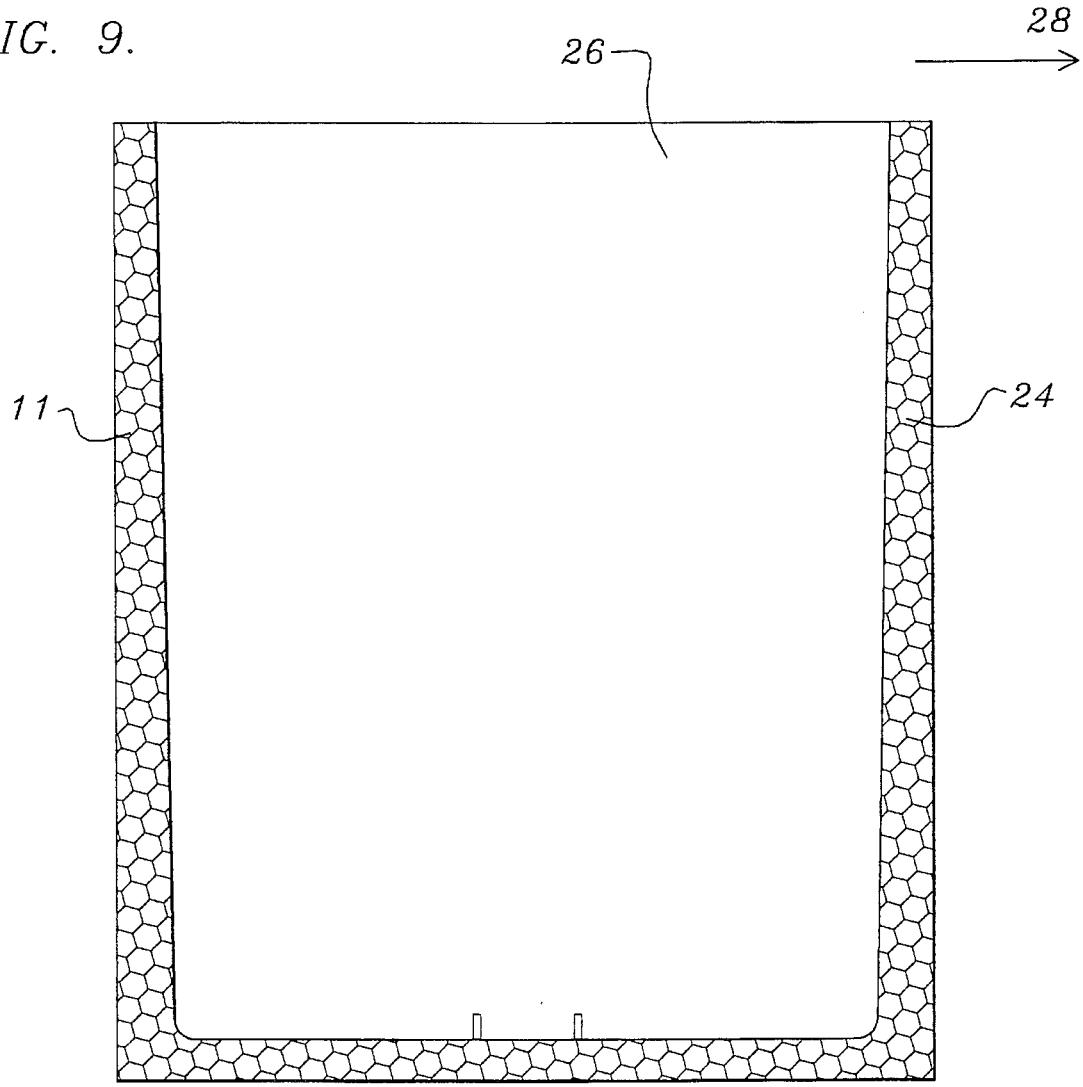
FIG. 9 is a transverse cross-sectional view of the environment-defining enclosure.

With reference to the schematic, partial breakaway view of FIG. 1, the invention may be seen to include an environment defining enclosure 24 which, as may be also seen in FIGS. 9 and 10, includes an upwardly-directed mouth 26 thereof, said mouth being vertically positioned at substantially a level at which workers will work upon automotive vehicles positioned upon the inventive system. As may be noted in FIGS. 1, 9 and 10, said environment-defining enclosure is characterized by a longitudinal axis 28 and a transverse axis 30.

It is to be appreciated that the actual vertical level of mouth 26 and enclosure 24 will be dictated by particular design considerations regarding the building within which the system is to be disposed. For example, in a typical application, enclosure 24 will be placed into an excavation of appropriate depth which has been formed for the purpose of accommodating the enclosure 24 such that the mouth 26 thereof will reside at substantially ground level. However, there will exist applications in which enclosure 24 will be placed within a building at a level beneath the level at which repair work on the vehicles is to be conducted. It is, accordingly, to be appreciated that the instant invention is not limited to the particular location of enclosure 24 whether such location be within soil or within a floor of a building beneath the level at which the automotive service work to be performed.

In either of the above set forth embodiments, mouth 26 is surrounded by means 32 for anchoring the enclosure 24 relative to reactive forces which are generated by vehicles during lifting thereof by the instant system. As may be noted in the views of FIGS. 1 and 5, said anchoring means is disposed at substantially the level 34 at which workers will typically stand during servicing activities. In that embodiment, anchoring means 32 will comprise a wide and deep peripherally disposed border about the entire mouth 26 of the enclosure 24.

Figure 5:
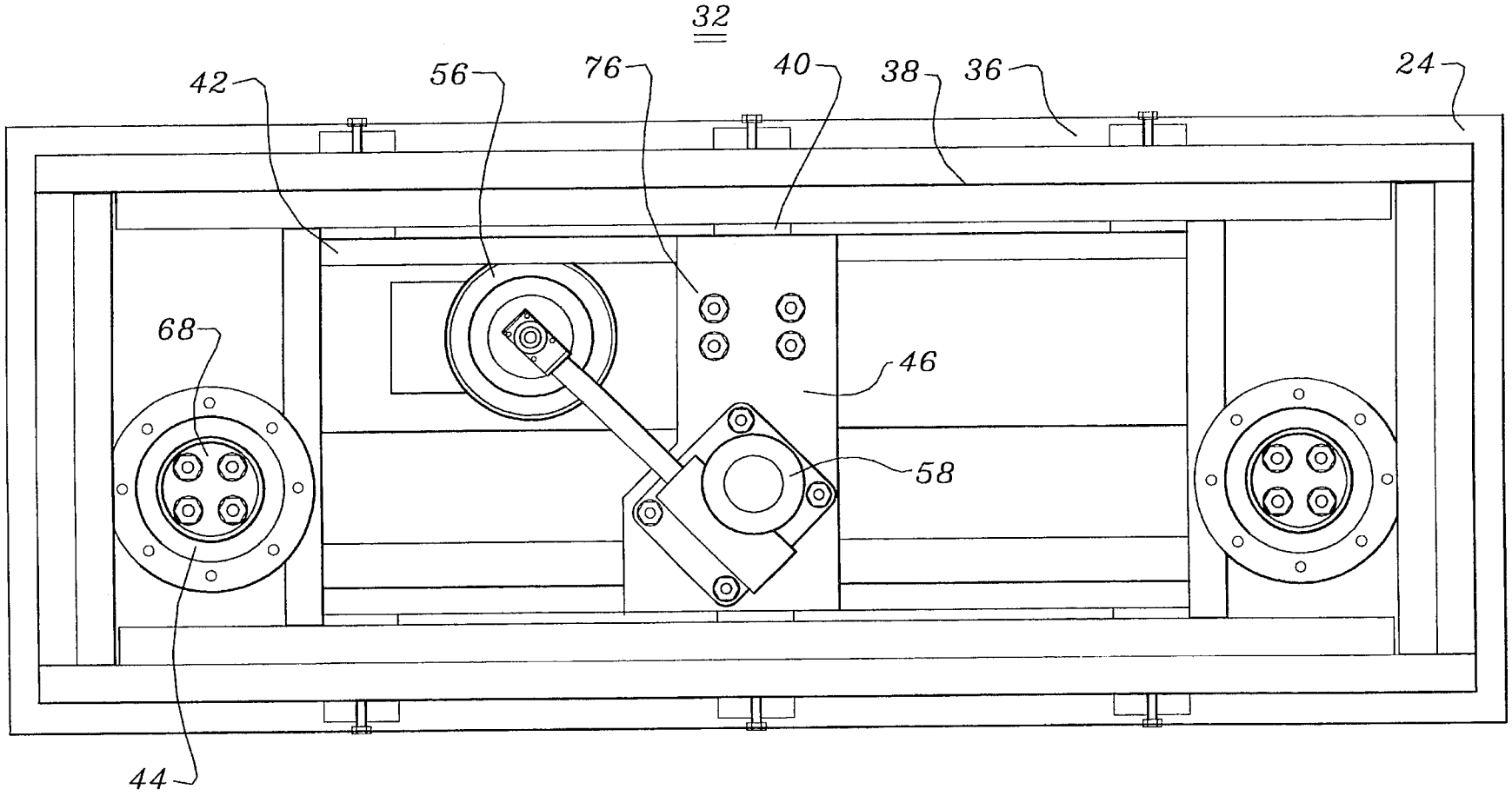
FIG. 5 is a top plan view of the inventive system.
Figure 11:
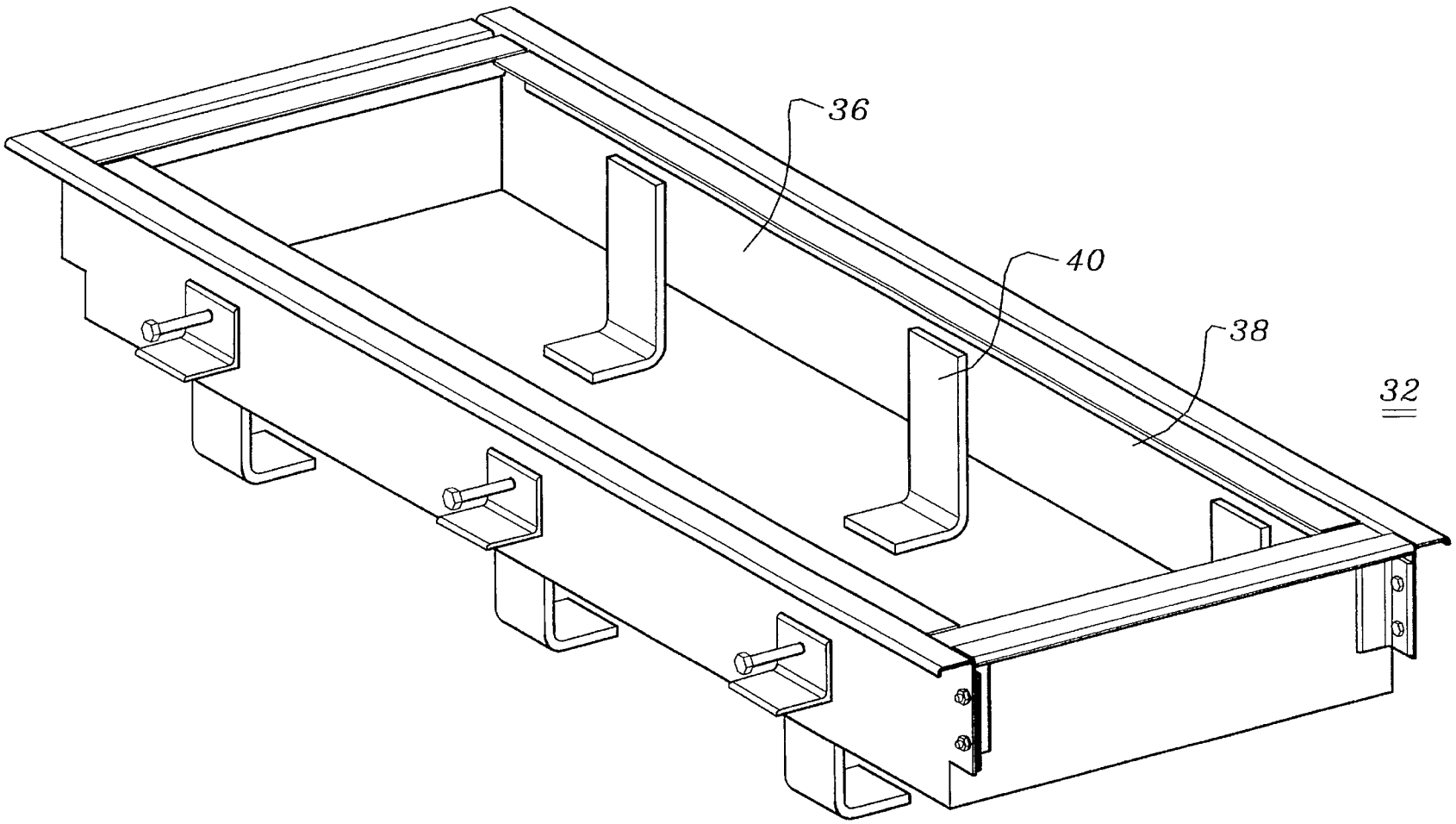
FIG. 11 is a perspective view of the intermediate assembly by which the upper support frame is secured to the means for anchoring said environment-defining enclosure relative to reactive forces generated during use of the system.

Immediately inwardly of said anchoring means 32 is an intermediate structure 36 and intermediate frame 38 which, as may be noted in FIGS. 1, 5 and 11, are secured upon inner surfaces of anchoring means 32, thereby defining a rigid horizontal plank across said mouth 26 of the environment-defining enclosure 24. Said support structure 36 is thereby co-parallel with the mouth of said enclosure.

As may be noted in FIG. 11, the intermediate structure is further provided with a plurality of clips 40, the function of which is to support an upper support frame 42 described more fully below.

Figure 6:
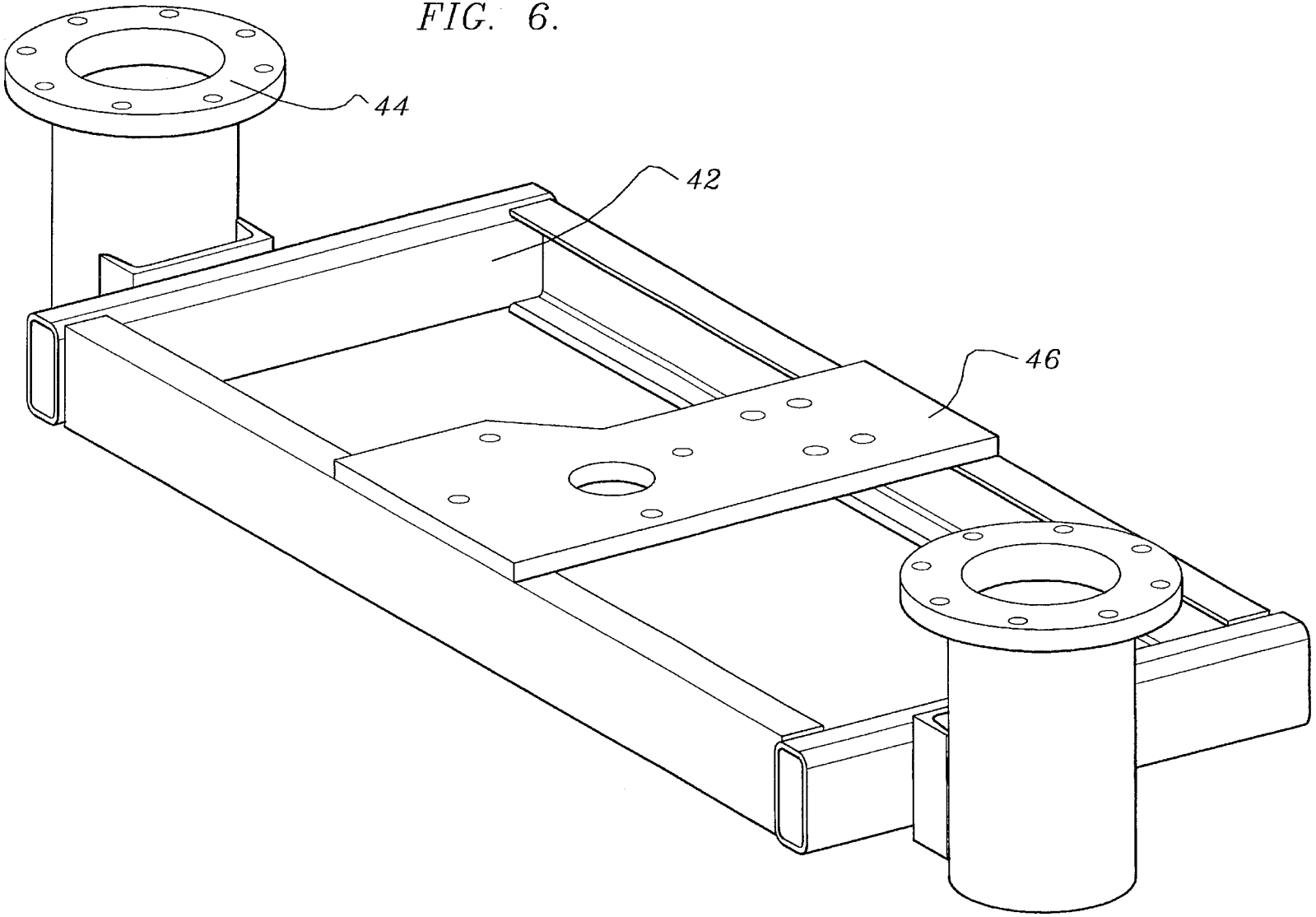
FIG. 6 is a perspective view as the support frame, vertical collars, and power support plate of the system.
Figure 7:
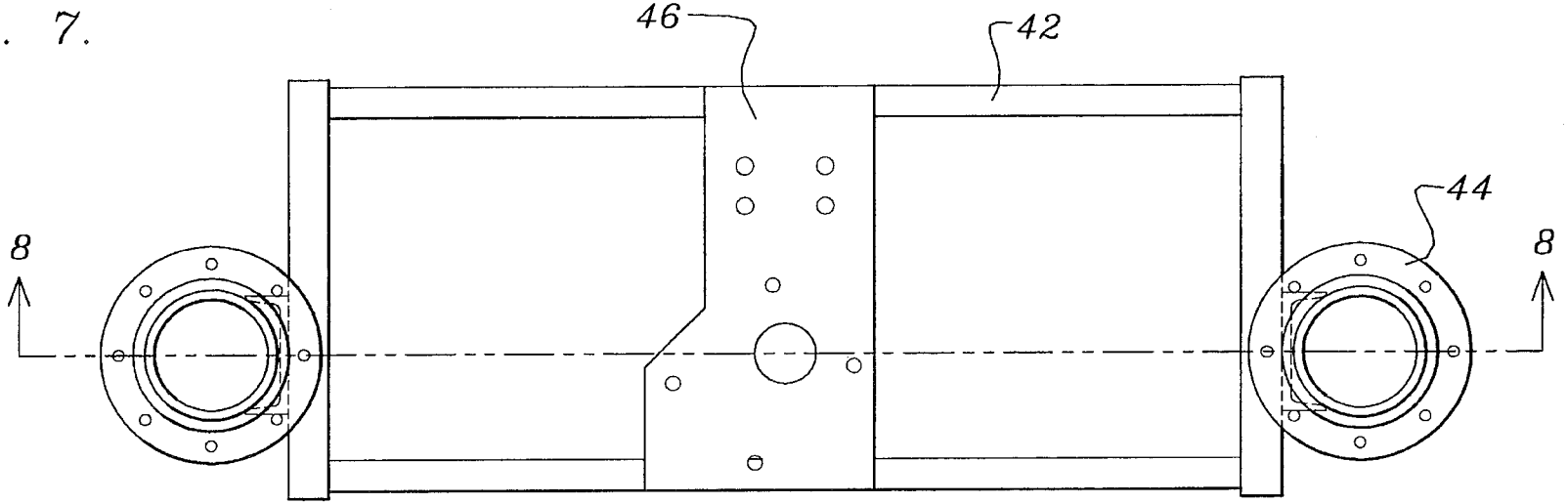
FIG. 7 is a top plan view of FIG. 6.
Figure 8:
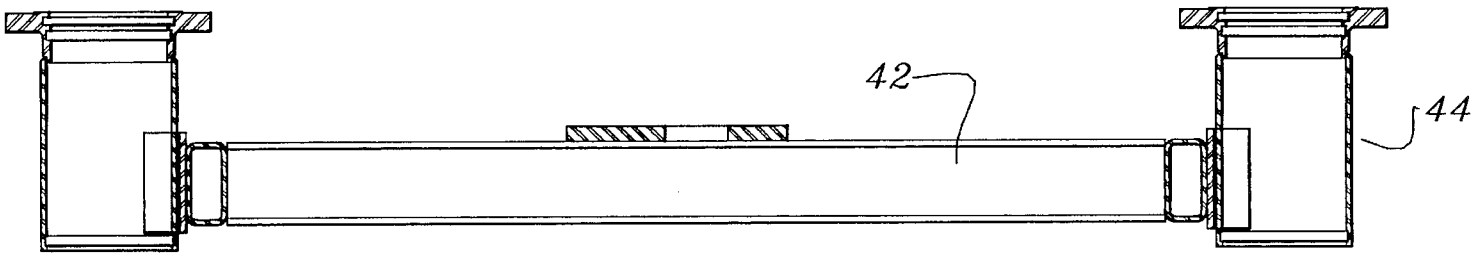
FIG. 8 is a vertical cross-sectional view taken along Line 8—8 of FIG. 7.

Said upper support frame 42 and its associated elements may be more fully seen with reference to the views of FIGS. 6 thru 8. Therein, in the perspective view of FIG. 6 may be seen said upper support frame 42 and, as well, vertically oriented cylindrical collars 44 which are secured at opposite longitudinal ends of the support frame 42. Further shown in said FIGS. 6 thru 8 is motor support plate 46 which creates a rigid transverse plank across upper support 42 which may be more fully appreciated in the view of FIG. 1.

In FIGS. 1 thru 5 may also be seen a vertically-oriented elongated screw drive 48, said drive having an upper end 50 and a lower end 52 (see FIG. 2), said upper end 50 thereof including an annular thrust bearing 54 (see FIGS. 1 thru 5). A power means or motor 56 is suspended from upper support frame 42 (see FIGS. 1 thru 4) and, thru a mechanical output 58 of linkage 60 thereof, imparts a selectable rotation to said upper end 60 of drive screw 48. That is, drive screw 48, which constitutes the primary lifting means the inventive system, is selectably rotated by the output 58 motor 56 as transmitted thereto by mechanical linkage 60. Pow means 56 may comprise any one of a number of single-phase motors having an output of at least 3 horsepower. Such motors are available from manufacturers including General Electric, Reliance Electric, and U.S. Motors.

It is noted that placing power means 56 at the upper end of the screw drive 48 places the drive in tension, rather than compression, thereby imposes less stress on the drive. Also, location of the power means at ground level affords ease of access and service.

Figure 2:
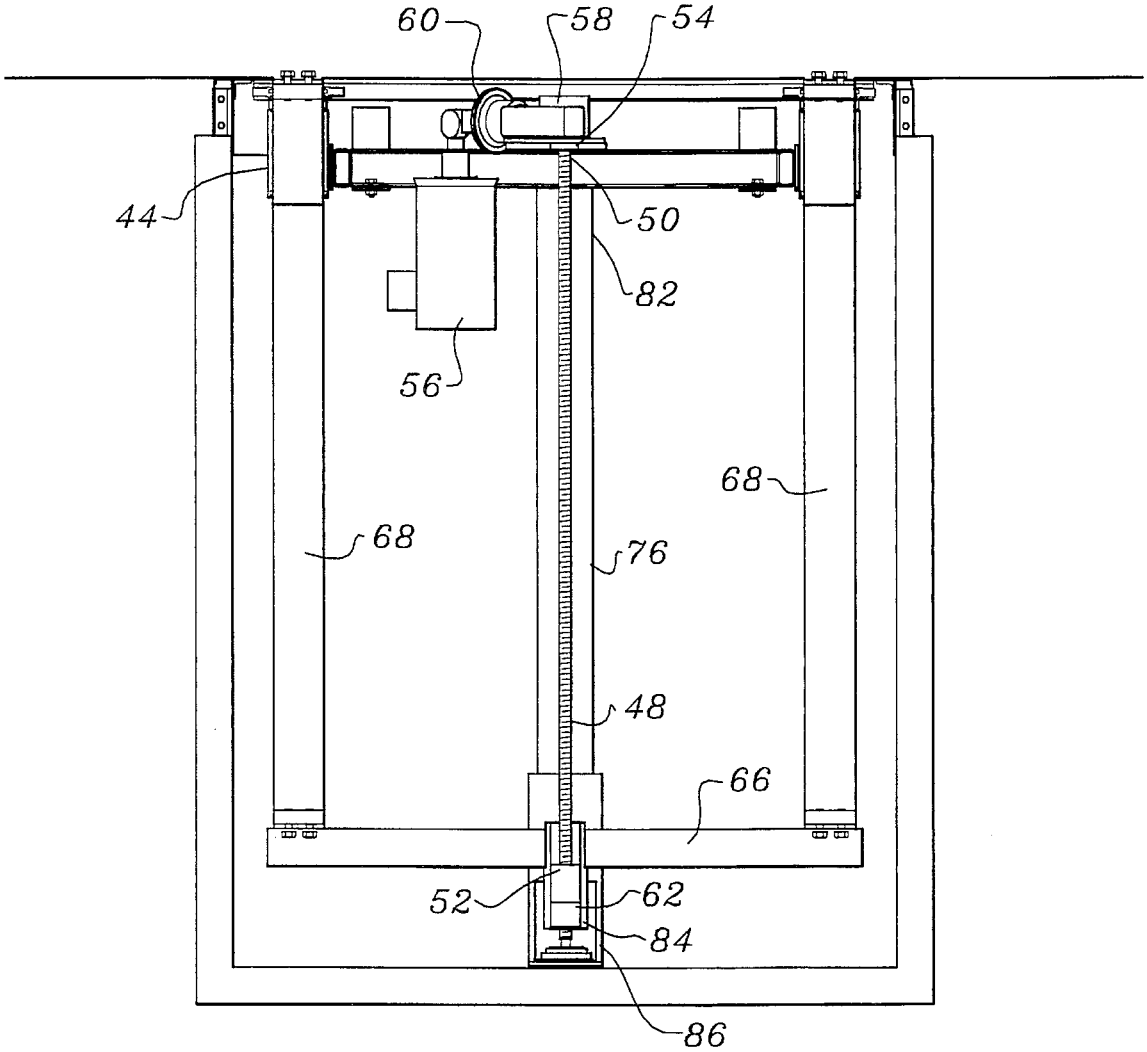
FIG. 2 is a front plan view in which the cross-beam and cylindrical plungers thereof are shown in their fully retracted position.
Figure 3:
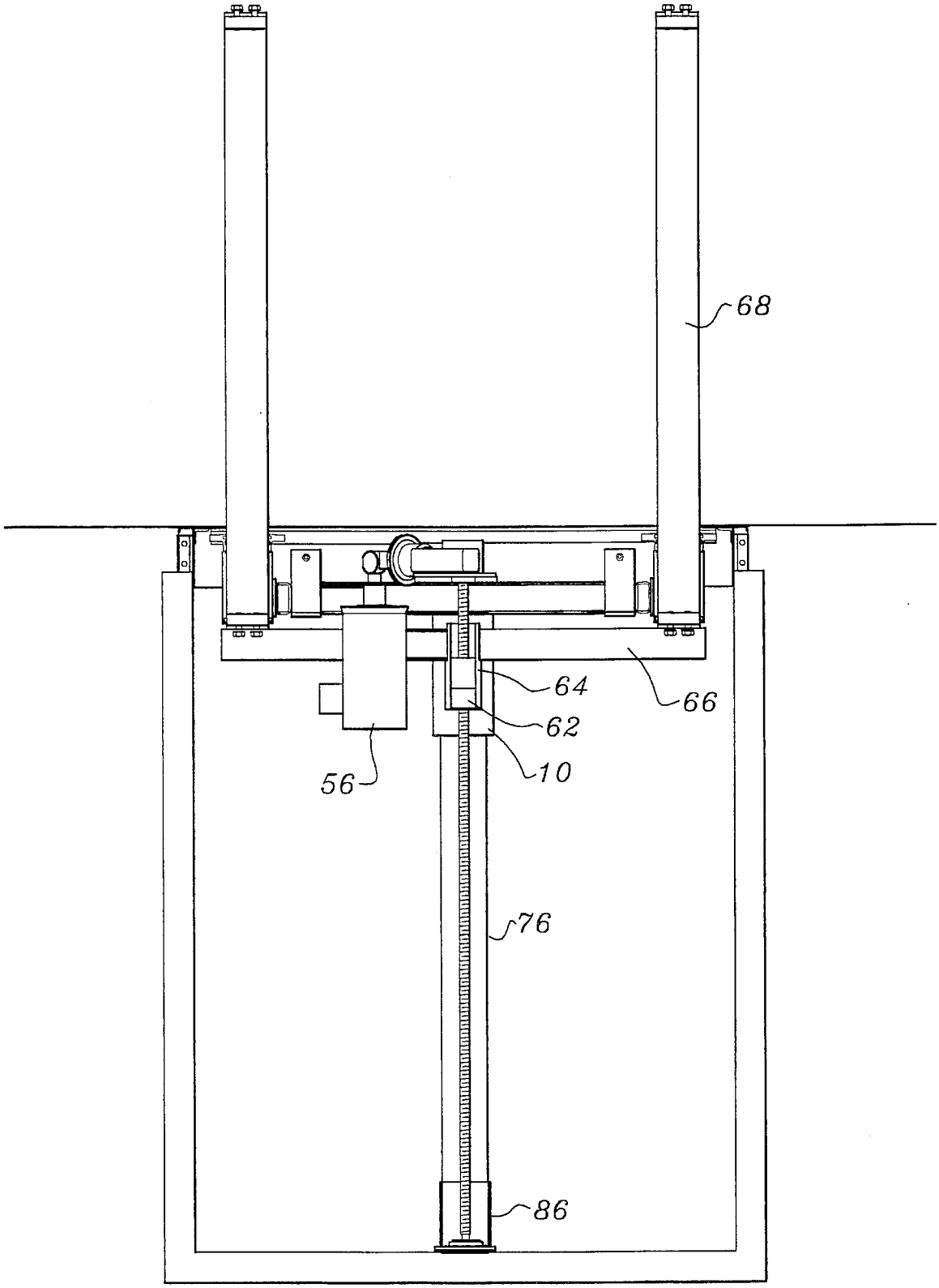
FIG. 3 is a front schematic view similar to the view of FIG. 2 in which the cross-beam and plungers are shown in a fully extended position.
Figure 4:
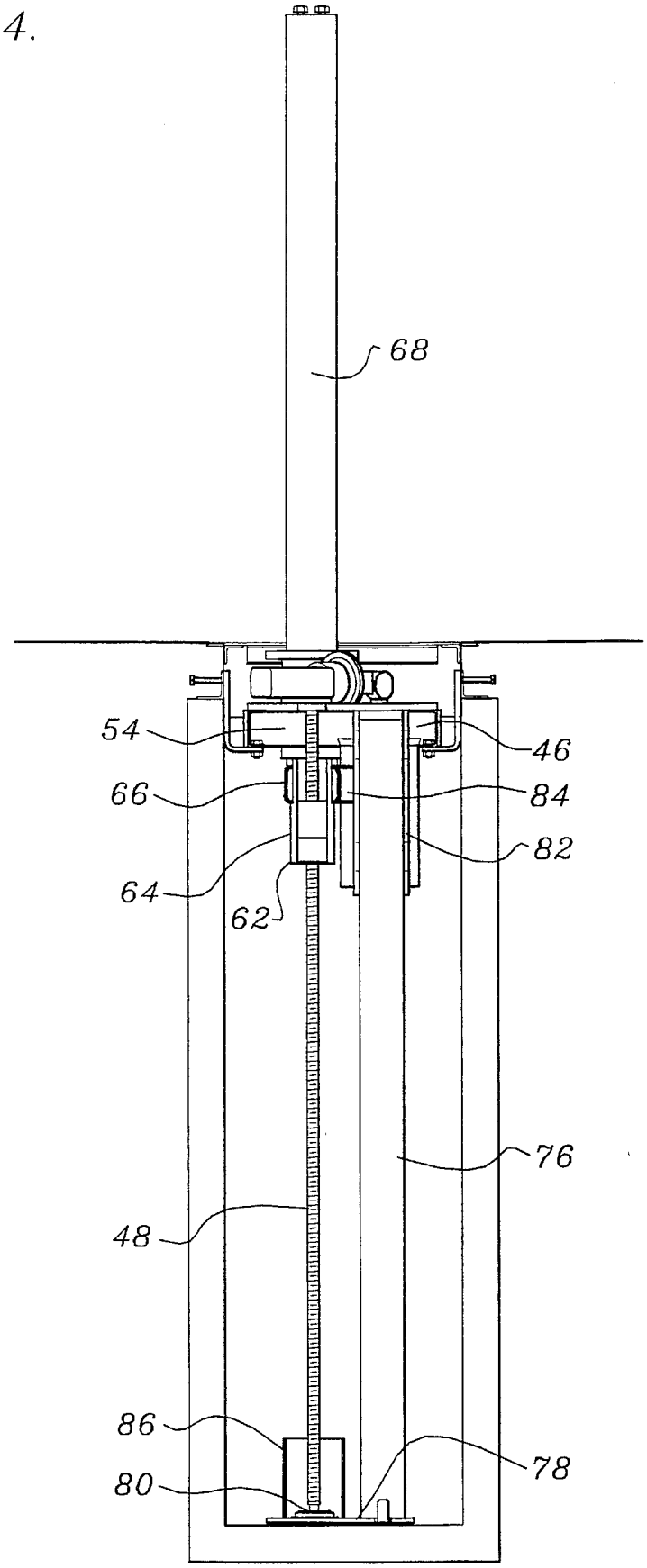
FIG. 4 is a side plan view taken along Line 4—4 of FIG. 3.

As may be noted in the views of FIGS. 2 thru 4, a load nut 62 is screw-threadably mounted about said screw drive 48.

A mechanical principle of the invention is that rotation of screw drive 48 results in an upward or downward travel of load nut 62. However, this principle of operation would be defeated if load nut 62 was permitted to rotate in unison with the rotating screw drive 48. In order to assure that load nut 62 will travel vertically relative to the rotation of screw drive 48, load nut 62 is rigidly secured at the periphery thereof to the interior of load nut support tube 64 which, in turn, is externally secured to cross-beam 66 which, by virtue of its mass and truss-like relation to other below-described elements of the system, will render rotation of load nut 62 impossible, Accordingly, all mechanical force transmitted by screw drive 48 to load nut 62 will be expressed in the form of either upward or downward linear translation, dependent upon whether screw drive 42 is rotated clockwise or counterclockwise by said output 58 of power means 56. As above noted, cross-beam 66, which spans substantially the longitudinal length of environment-defining closure 24, rests upon load nut support tube 64 which, as above noted, is rigidly secured to load nut 62. This entire mechanical combination will, as may be noted in the views of FIGS. 2 and 3, move upwardly or downwardly responsive to rotation of screw drive 48 by the power means 56.

As may be noted in the views of FIGS. 1 thru 4, a pair of vertically disposed cylindrical plungers 68, each having upper ends 70 and lower ends 72, are secured, at said lower ends 72 thereof, upon said cross-beam 66. Each of said plungers 68 passes vertically upwardly through a respective one of said collars 44. Attached to upper end 70 of each plunger 68 is an automotive superstructure support means 74 upon which the vehicle to be serviced by the instant system is positioned placed prior to lifting.

Stabilization of the combination of said superstructure 74, plungers 68 and cross-beam 66, relative to screw drive 48 may, in a given embodiment of the invention, be achieved through the use of a vertically-oriented support tube 76 which, as may be noted in the views of FIGS. 1 and 4, extends from a base plate 78 (as does an axial load bearing 80) to the level of said power means support plate 46.

Also shown in FIG. 2 to the right of said thrust bearing 54 is an upper end of the support tube 76. Shown at opposite ends of upper support structure 42 are said collar means 44 and said plungers 68 which pass slidably therethrough.

Circumferentially surrounding a segment of support tube 76 is load equalization means 82 (see FIG. 4) which, through rigid cross-link 84, is in mechanical communication with cross-beam 66. In other words, any torque generated by a shifting of cross-beam 66 in any plane will be transmitted to cross-link 84 and, therefrom, to equalization means 82 which is itself stabilized by said support tube 76. The support tube 76, being secured at both its upper and lower ends to rigid substantially immoveable planes, will absorb and diffuse whatever loads are transmitted thereto through loading and normal use of the instant system.

It is to be appreciated that other load equalization means may be employed to impart suitable stability to the mechanical combination of screw drive 48, cross beam 66, superstructure 74 and vehicles loaded thereon.

With reference to the top plan view of FIG. 5 there is shown the manner in which of the above described elements appear from what would typically comprise ground level, Therein, may more particularly be seen anchoring means 32, intermediate structure 36, and intermediate frame 38. Connected thereto, by clip 40, is support plane 42 and, therewith, power means support plate 46, power means 56 and power means output 58 which, as above noted, causes annular thrust bearing 56 to effect rotation of upper end 50 of screw drive 48, See also FIG. 11.

Other features shown in the figures (see FIGS. 1–4) includes a lubrication bath 86, the purpose of which is to provide to load nut 62 and its associated load nut support tube 64 an appropriate lubricating environment when the assembly is in its fully retracted position as, typically, is the case during periods of non-use, such as evenings and weekends. Further, the structure of load nut support tube 64 is such that it will entrain a certain quantity of lubricating material thereon which, during use of the system, will drip downwardly onto screw drive 48 thereby providing a dynamic lubrication of the system during usage.

With Further reference to FIG. 1 there may be seen a dip stick 88 the purpose of which is to enable a user of the system to ascertain the amount of lubrication within lubrication bath 86 at any given point in time and, as well, the characteristic of the lubricating material.

A further aspect of the invention, shown in the perspective view of FIG. 1 is upper bellows 90 and lower bellows 92, the function of which is to protect screw drive 48, load nut 62 and load nut support tube 64 from any forms of contamination to which they might otherwise become subject. As may be appreciated, bellows 90 and 92 must be axially resilient and expansible to accommodate the downward retraction and upward extension of cross beam 66. Said bellow may comprise any of a variety of materials having suitable characteristics. Such materials include canvas and plastics including neoprene.

Figure 12:
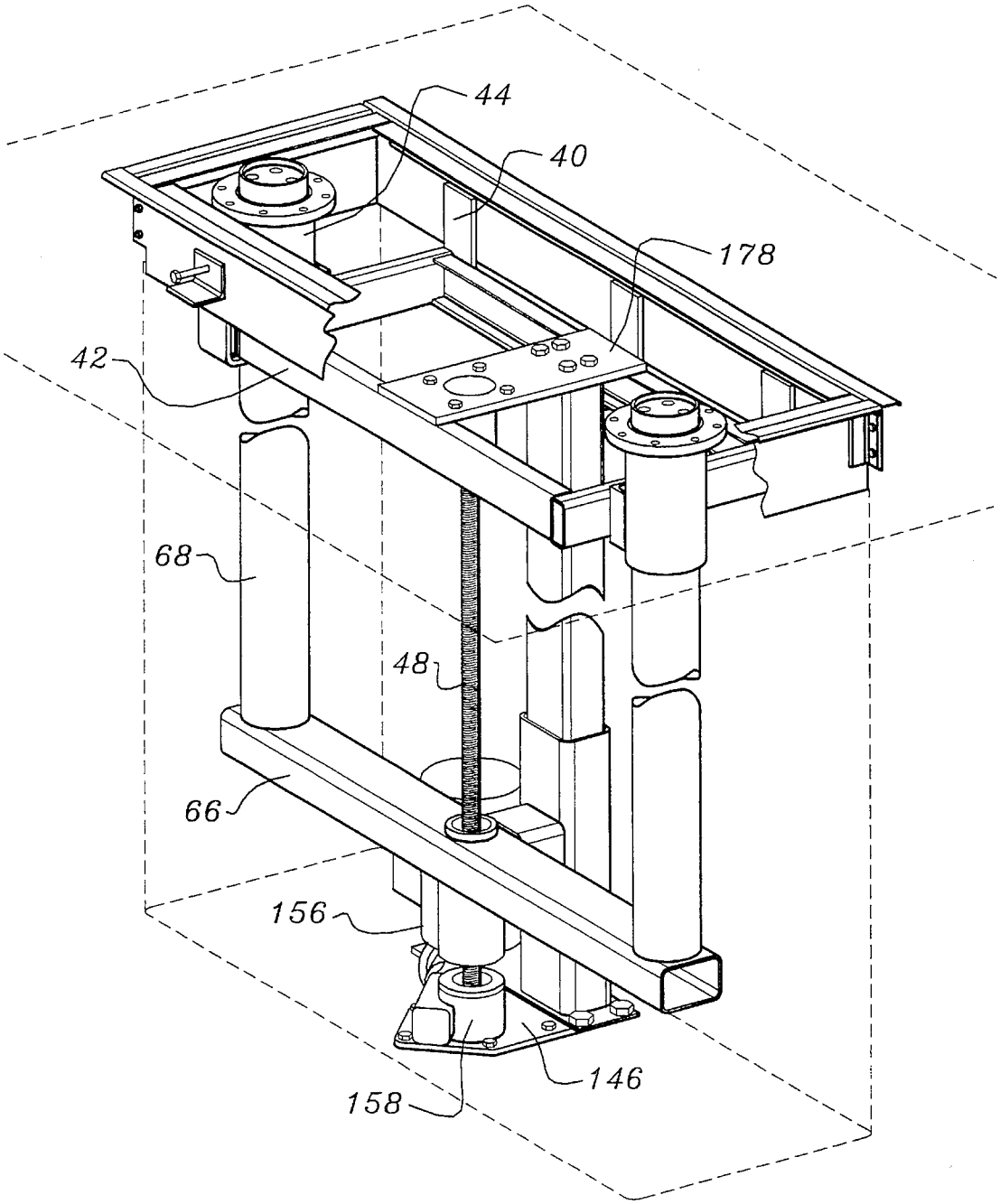
FIG. 12 is a perspective view of a further embodiment of the invention having the thrust bearing, and power means therefore, at the lower end of the screw drive.

With reference to FIG. 12, there is shown a further embodiment of the invention in which power means 156 for the screw drive 48 is located upon the floor of enclosure 24. Therein, the power means 156 provides an output which rotates a lower annular thrust bearing 158, positioned on a lower support plate 146, which in turn effects the rotation of screw drive 48. At the upper end of the screw drive is provided an upper base plate 178 which contains said bearing 178 which enables the upper end of screw drive 48 to rotate. As may be noted, lubrication bath 186 is positioned above lower thrust bearing 158. The system of FIG. 12, in all respects other than the above, operates in the same fashion as the embodiment of FIGS. 1 to 11.

Figure 13:
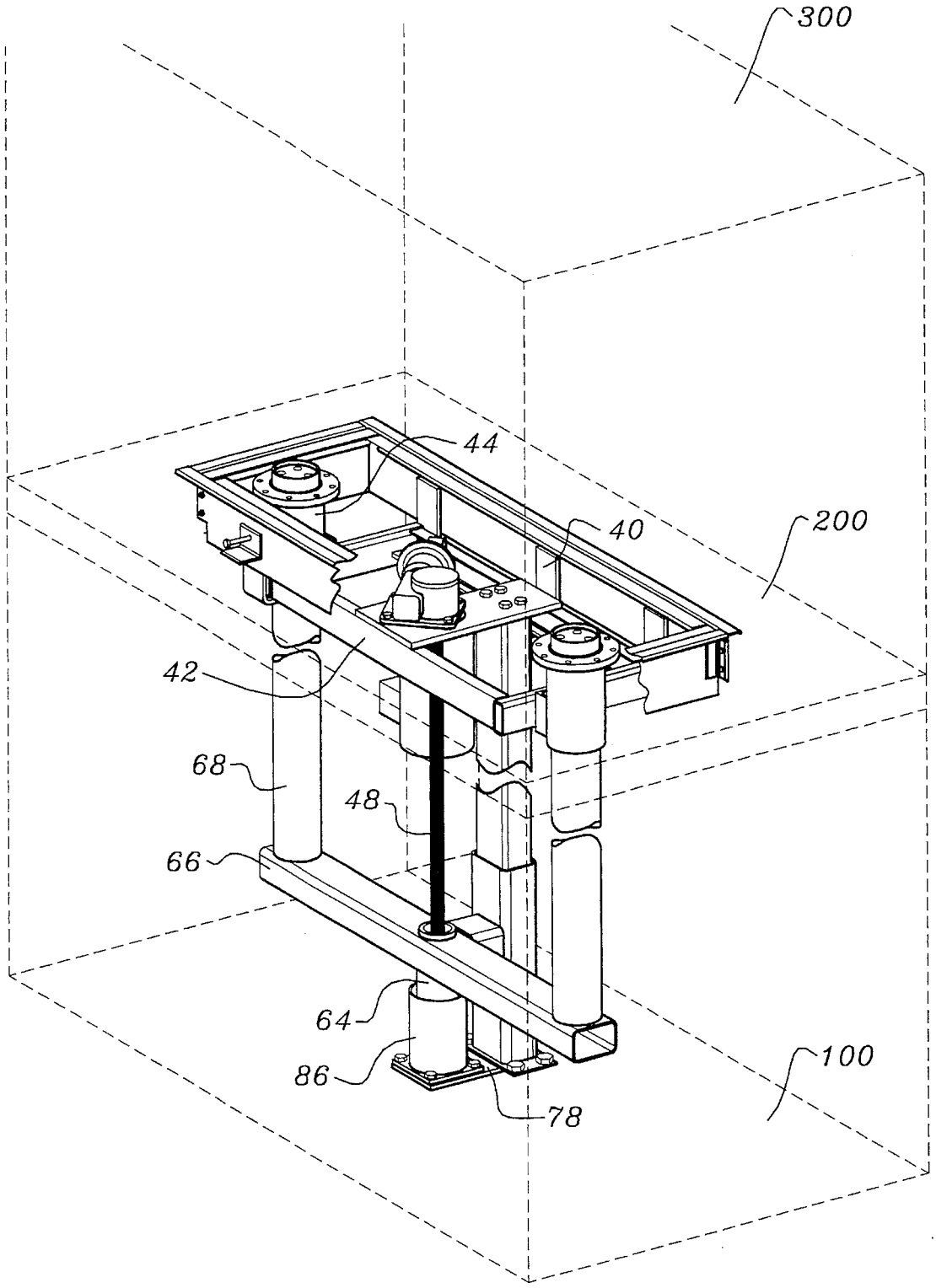
FIG. 13 is a perspective view of the invention showing the location of the screw drive assembly within a lower level of multi level structure.

In FIG. 13 is shown the use of the present invention within a multi-level building having levels 100, 200 and 300. In this use of the invention, lower base plate 78 rests on level 100 while an anchoring means is provided within level 200. The region of extension of the plungers 68 then occurs between levels 200 and 300.

While there has been shown and described the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the claims appended herewith.

Having thus described my invention what I claim as new, useful and non-obvious and, accordingly, secure by Letters Patent of the United States is:

1. An automotive screw lift system, comprising:

(a) an environment-defining enclosure having an upwardly directed mouth, said mouth positioned substantially at a work level of the system, said enclosure defining both a longitudinal and a transverse axis;

(b) means for anchoring of said enclosure relative to reactive forces generated by vehicles during lifting thereof by said system, said anchoring means disposed substantially at said work level and peripherally about and to said mouth of said enclosure;

(c) a rigid support structure secured tip on inner surfaces of said anchoring means, thereby defining a rigid horizontal plane substantially across said mouth of said enclosure and co-parallel therewith;

(d) vertically directed guide means secured to longitudinally opposite ends of said support frame;

(e) a vertically-oriented elongated screw drive having an upper end and a lower end, said upper end including an annular thrust bearing positioned at about the level of said support frame and said lower end thereof including a screw drive support bearing;

(f) power means for imparting selectable rotation to said screw drive, an output of said power means in mechanical linkage to said thrust bearing of said screw drive;

(g) a load nut screw-threadably mounted upon said screw drive, said nut comprising means for facilitating upward and downward travel upon said screw drive;

(h) a load nut mounting tube, secured radially outwardly of said screw drive, said tube having a interior portion thereof rigidly mounted upon said load nut, thereby preventing the rotation thereof;

(i) a pair of vertically-disposed plungers, each having an upper end and a lower end, each lower end thereof secured upon a cross-beam, each plunger passing vertically upwardly through a respective one of said collars; and (j) automotive superstructure support means secured to each of said upper ends of said cylindrical plungers.

2. The system as recited in claim 1, in which said environment-defining enclosure comprises a substantially in-ground enclosure.

3. The automotive system as recited as in claim 1, in which said environment-defining enclosure comprises a lower level of a multi-level automotive lift environment.

4. The system as recited in claim 2, in which said anchoring means comprises in-ground anchoring means.

5. The system as recited in claim 1, further comprising:

a power means support plate secured upon said upper support frame to which said power means is secured.

6. The system as recited in claim 1, further comprising:

a support tube vertically oriented., co-parallel to said screw drive and oriented substantially co-parallel to said screw drive and having a length substantially co-equal thereto; and load equalization means circumferentially and slidably surrounding a segment of said support tube, said load equalization means secured to said horizontal cross beam.

7. The system as recited in claim 1, further comprising:

a lubrication bath circumferentially surrounding a lower portion of said screw drive.

8. The system as recited in claim 7, further comprising:

a dip stick for monitoring the level and characteristic of said lubrication bath at substantially the level of said anchoring means.

9. The system as recited in claim 1, further comprising:

a bottom support plate for supporting said screw drive support bearing at said lower end of said screw drive.

10. The system as recited in claim 1, further comprising:

axially expansible bellow means radially surrounding portions of said screw drive situated both above and below said cross-beam.

11. An automotive screw lift system, comprising:

(a) an environment-defining enclosure having an upwardly directed mouth, said mouth positioned substantially at a work level of the system, said enclosure defining both a longitudinal and a transverse axis;

(b) means for anchoring of said enclosure relative to reactive forces generated by vehicles during lifting thereof by said system, said anchoring means disposed substantially at said work level and peripherally about and to said mouth of said enclosure;

(c) a rigid support structure secured upon inner surfaces of said anchoring means, thereby defining a rigid horizontal plane substantially across said mouth of said enclosure and co-parallel therewith;

(d) vertically directed guide means secured to longitudinally opposite ends of said support frame;

(e) a vertically-oriented elongated screw drive having an upper end and a lower end, said lower end including an annular thrust bearing, and said upper end thereof including a screw drive support bearing;

(f) power means for imparting selectable rotation to said screw drive, an output of said power means in mechanical linkage to said thrust bearing of said screw drive;

(g) a load nut screw-threadably mounted upon said screw drive, said nut comprising means for facilitating upward and downward travel upon said screw drive;

(h) a load nut mounting tube, secured radially outwardly of said screw drive, said tube having a interior portion thereof rigidly mounted upon said load nut, thereby preventing the rotation thereof;

(i) a pair of vertically-disposed plungers, each having an upper end and a lower end, each lower end thereof secured upon a cross-beam, each plunger passing vertically upwardly through a respective one of said collars; and (j) automotive superstructure support means secured to each of said tipper ends of said cylindrical plungers.

12. The system as recited in claim 11, in which said environment-defining enclosure comprises a substantially in-ground enclosure.

13. The automotive system as recited as in claim 11, in which said environment-defining enclosure comprises a lower level of a multi-level automotive lift environment.

14. The system as recited in claim 12, in which said anchoring means comprises in-ground anchoring means.

15. The system as recited in claim 11, further comprising:

a power means support plate secured upon said upper support frame to which said power means is secured.

16. The system as recited in claim 11, further comprising:

a support tube vertically oriented, co-parallel to said screw drive and oriented substantially co-parallel to said screw drive and having a length substantially co-equal thereto; and load equalization means circumferentially and slidably surrounding a segment of said support tube, said load equalization means secured to said-horizontal cross beam.

17. The system as recited in claim 11, further comprising:

a lubrication bath circumferentially surrounding a lower portion of said screw drive.

18. The system as recited in claim 17, further comprising:

a dip stick for monitoring the level and characteristic of said lubrication bath at substantially the level of said anchoring means.

19. The system as recited in claim 11, further comprising:

a bottom support plate for supporting said screw drive support bearing at said lower end of said screw drive.

20. The system as recited in claim 11, further comprising:

axially expansible bellow means radially surrounding portions of said screw drive situated both above and below said cross-beam.

* * * * *